US008192217B2

(12) United States Patent
Zhu

(10) Patent No.: US 8,192,217 B2
(45) Date of Patent: Jun. 5, 2012

(54) BOARD TO BOARD CONNECTOR WITH LOW PROFILE

(75) Inventor: Yu Zhu, Shenzhen (CN)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 13/069,385

(22) Filed: Mar. 23, 2011

(65) Prior Publication Data

US 2011/0294351 A1 Dec. 1, 2011

(30) Foreign Application Priority Data

May 31, 2010 (CN) ..... 2010 1 0187215

(51) Int. Cl.
*H01R 13/28* (2006.01)

(52) U.S. Cl. ..... 439/284

(58) Field of Classification Search ..... 439/284, 439/638, 74, 78

See application file for complete search history.

(56) References Cited

U.S. PATENT DOCUMENTS 3,065,447 A * 11/1962 Maurer ..... 439/246
3,091,746 A * 5/1963 Winkler ..... 439/295
3,600,531 A * 8/1971 Hoegerl ..... 200/51.1
3,829,818 A * 8/1974 Iosue et al. ..... 439/510
3,941,443 A * 3/1976 Reimer ..... 439/510
4,029,377 A * 6/1977 Guglielmi ..... 439/510
4,033,657 A * 7/1977 Kemper ..... 439/510
4,150,864 A * 4/1979 Walter ..... 439/510
4,152,041 A * 5/1979 Hollyday et al. ..... 439/188
4,352,534 A * 10/1982 Johnson ..... 439/510
4,501,459 A * 2/1985 Chandler et al. ..... 439/295
4,552,425 A * 11/1985 Billman ..... 439/295
4,582,376 A * 4/1986 Olsson ..... 439/514
4,721,471 A * 1/1988 Mueller ..... 439/78
4,737,118 A * 4/1988 Lockard ..... 439/295
4,756,695 A * 7/1988 Lane et al. ..... 439/76.1
4,799,589 A * 1/1989 Peleckis ..... 206/716
4,836,799 A * 6/1989 Tomer ..... 439/284
4,971,565 A * 11/1990 Fox, Jr. ..... 439/74
4,988,307 A * 1/1991 Muzslay ..... 439/188
4,990,094 A * 2/1991 Chandler et al. ..... 439/108
5,098,311 A * 3/1992 Roath et al. ..... 439/295
5,161,985 A * 11/1992 Ramsey ..... 439/74
5,167,528 A * 12/1992 Nishiyama et al. ..... 439/489
5,169,324 A * 12/1992 Lemke et al. ..... 439/101
5,174,777 A * 12/1992 Carter ..... 439/290
5,181,855 A * 1/1993 Mosquera et al. ..... 439/74
5,192,232 A * 3/1993 Lenz et al. ..... 439/660

(Continued)

*Primary Examiner* — Tulsidas C Patel
*Assistant Examiner* — Vladimir Imas
(74) *Attorney, Agent, or Firm* — Wei Te Chung; Andrew C. Cheng; Ming Chieh Chang

(57) ABSTRACT

A battery connector includes an insulative housing and a plurality of terminals retained in the housing. The housing defines a mating surface, a rear surface opposite to the mating surface and a plurality of passageways penetrating through the mating surface and the rear surface along a front-to-back direction. At least one pair of first grooves is formed in opposite inner sidewalls of each passageway and running through the rear surface. A pair of slits communicates and is staggered with the corresponding first grooves along a vertical direction perpendicular to the front-to-back direction. Each terminal includes a retention portion with at least one pair of barbs defined at two sides thereof. The retention portions pass through the first grooves along the front-to-back direction and are pressed along the vertical direction so as to retain the barbs in the corresponding slits.

20 Claims, 4 Drawing Sheets

U.S. PATENT DOCUMENTS 5,199,884 A * 4/1993 Kaufman et al. ..... 439/74
5,218,293 A * 6/1993 Kan ..... 324/754.14
5,328,380 A * 7/1994 Carney ..... 439/188
5,462,445 A * 10/1995 Anhalt ..... 439/188
5,487,682 A * 1/1996 Miller et al. ..... 439/607.01
5,498,167 A * 3/1996 Seto et al. ..... 439/74
5,639,248 A 6/1997 Yagi
5,655,930 A * 8/1997 Dechelette et al. ..... 439/571
5,707,242 A * 1/1998 Mitra et al. ..... 439/74
6,036,534 A * 3/2000 Hoyt et al. ..... 439/510
6,048,482 A * 4/2000 Lemke et al. ..... 264/251
6,065,951 A * 5/2000 Lemke et al. ..... 425/123
6,099,347 A * 8/2000 Hoyt et al. ..... 439/510
6,242,698 B1 * 6/2001 Baker et al. ..... 174/72 A
6,574,855 B1 * 6/2003 Hida ..... 29/622
6,702,590 B2 * 3/2004 Zaderej et al. ..... 439/74
6,729,913 B2 * 5/2004 Bruski et al. ..... 439/676
6,926,539 B2 * 8/2005 Zaderej et al. ..... 439/74
6,957,974 B2 * 10/2005 Bruski et al. ..... 439/344
6,977,350 B2 * 12/2005 Chen et al. ..... 200/1 R
7,785,152 B2 * 8/2010 Yi et al. ..... 439/660
7,798,836 B2 * 9/2010 Lappoehn ..... 439/291
2003/0013325 A1 * 1/2003 Zaderej et al. ..... 439/74
2003/0049958 A1 * 3/2003 Bruski et al. ..... 439/344
2004/0198077 A1 * 10/2004 Zaderej et al. ..... 439/74
2005/0196998 A1 * 9/2005 Bruski et al. ..... 439/344

* cited by examiner

BOARD TO BOARD CONNECTOR WITH LOW PROFILE

FIELD OF THE INVENTION

The present invention generally relates to a connector, and more particularly to a board to board connector with a low profile.

DESCRIPTION OF PRIOR ART

U.S. Pat. No. 5,639,248 discloses a board to board connector assembly including male and female connectors mating with each other in a mating direction. The male connector includes a plurality of male terminals mounted in a male housing. Each male terminal includes a contact beam extending in the mating direction and mounted in a sidewall of the housing. The female connector includes a plurality of female terminals mounted in a female housing. Each female terminal includes a contact beam extending in said mating direction and a curved contact near its top end. However, the connector assembly has a higher profile.

Hence, an improved board to board connector is highly desired to overcome the aforementioned problems.

SUMMARY OF THE INVENTION

The present invention provides a battery connector comprising an insulative housing and a plurality of terminals retained in the insulative housing. The insulative housing defines a mating surface, a rear surface opposite to the mating surface and a plurality of passageways penetrating through the mating surface and the rear surface along a front-to-back direction. At least one pair of first grooves is formed in opposite inner sidewalls of each passageway and running through the rear surface. A pair of slits communicates and is staggered with the corresponding first grooves along a vertical direction perpendicular to the front-to-back direction. Each terminal comprises a retention portion with at least one pair of barbs defined at two sides thereof. The retention portions pass through the first grooves along the front-to-back direction and are pressed along the vertical direction so as to retain the barbs in the corresponding slits.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
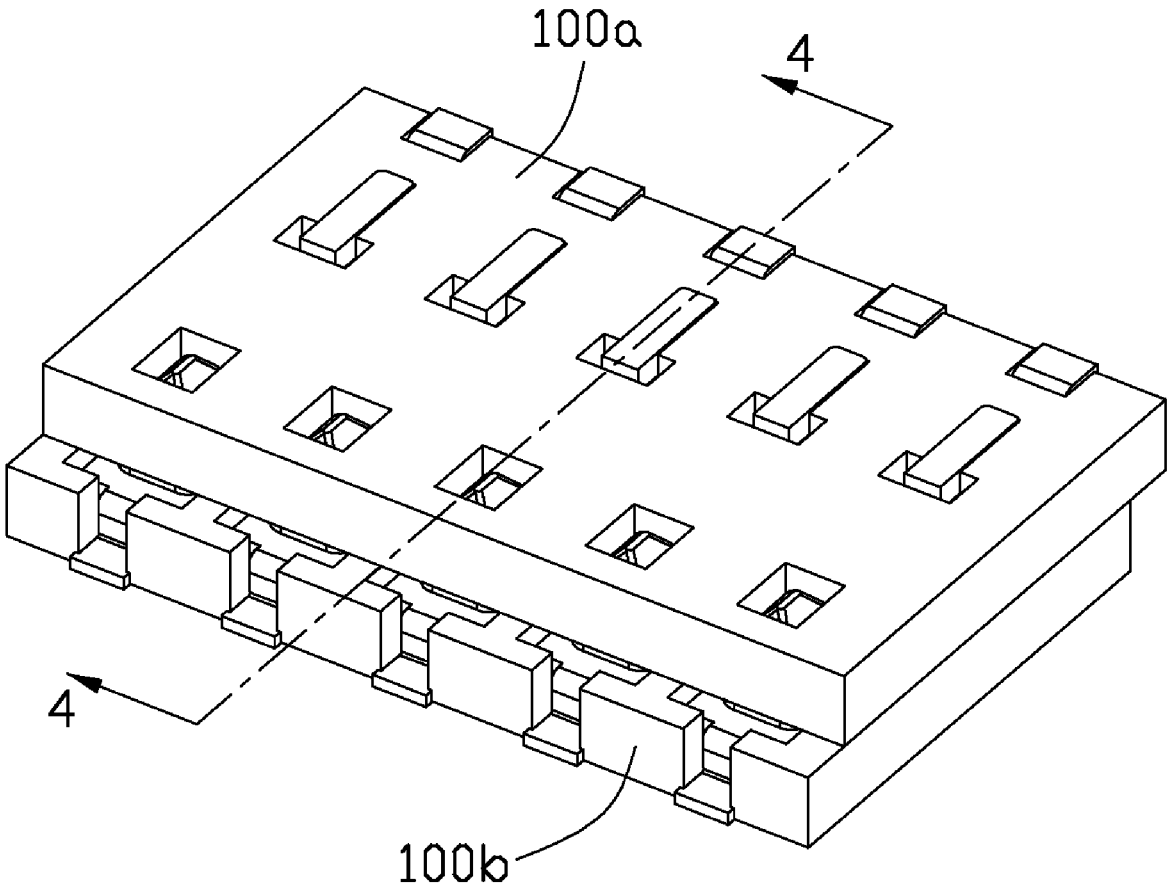
FIG. 1 is an assembled, perspective view of the board to board connector assembly.

Referring to FIG. 1, a pair of identical connectors 100*a* and 100*b* for coupling two printed circuit boards (PCBs, not shown) mates with each other to form a electrical connection between the two PCBs. The connectors 100*a* and 100*b* are identical. Therefore, only configuration of connector 100*a* will be described in detail. Elements in connector 100*b* which are identical to the elements of connector 100*a* are numbered with the same digits as the elements in connector 100*a*. The board to board connector 100*a* comprises a rectangular insulative housing 1 and first and second terminals retained in the housing 1.

Figure 2:
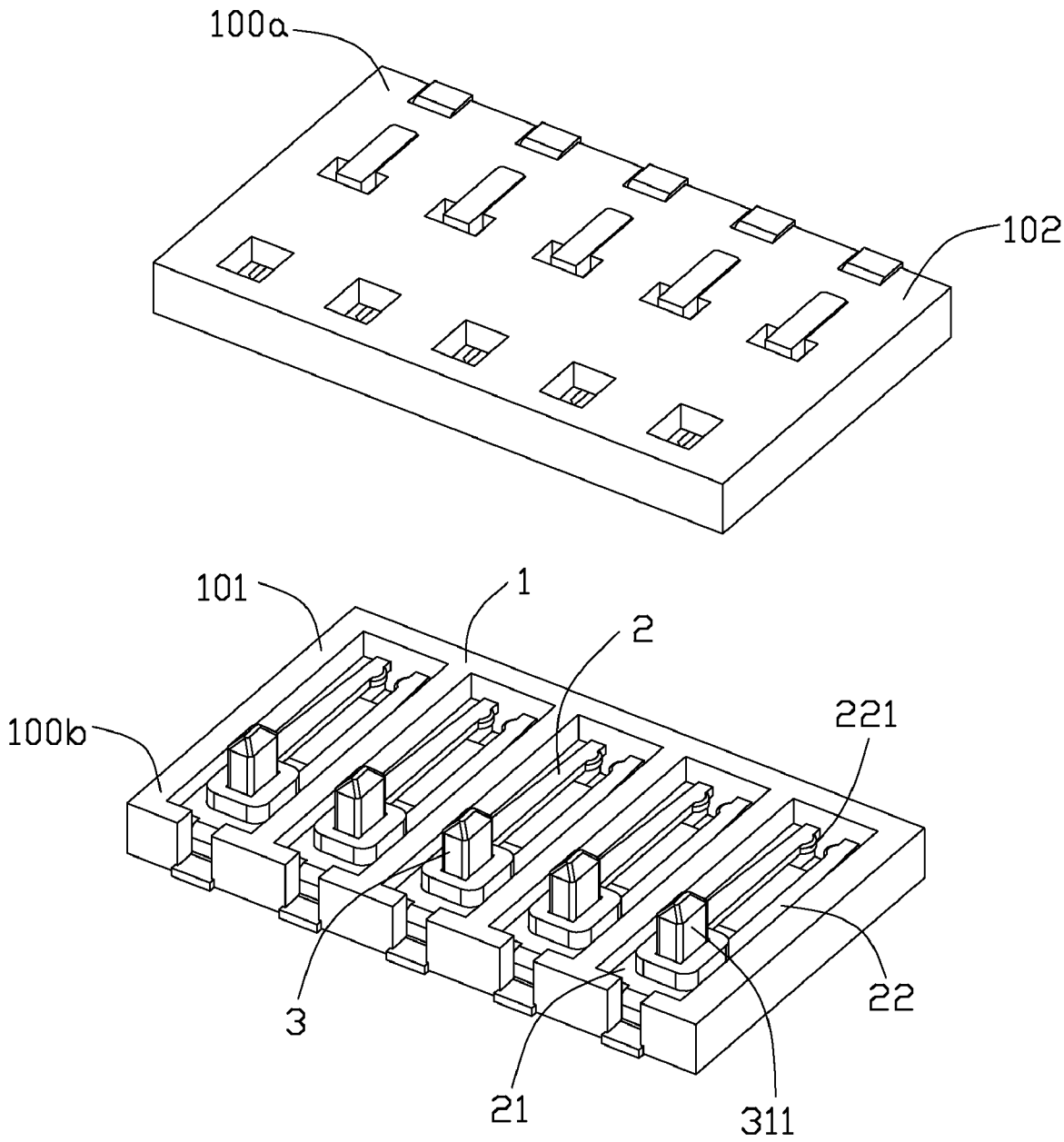
FIG. 2 is a partially exploded, perspective of FIG. 1.
Figure 3:
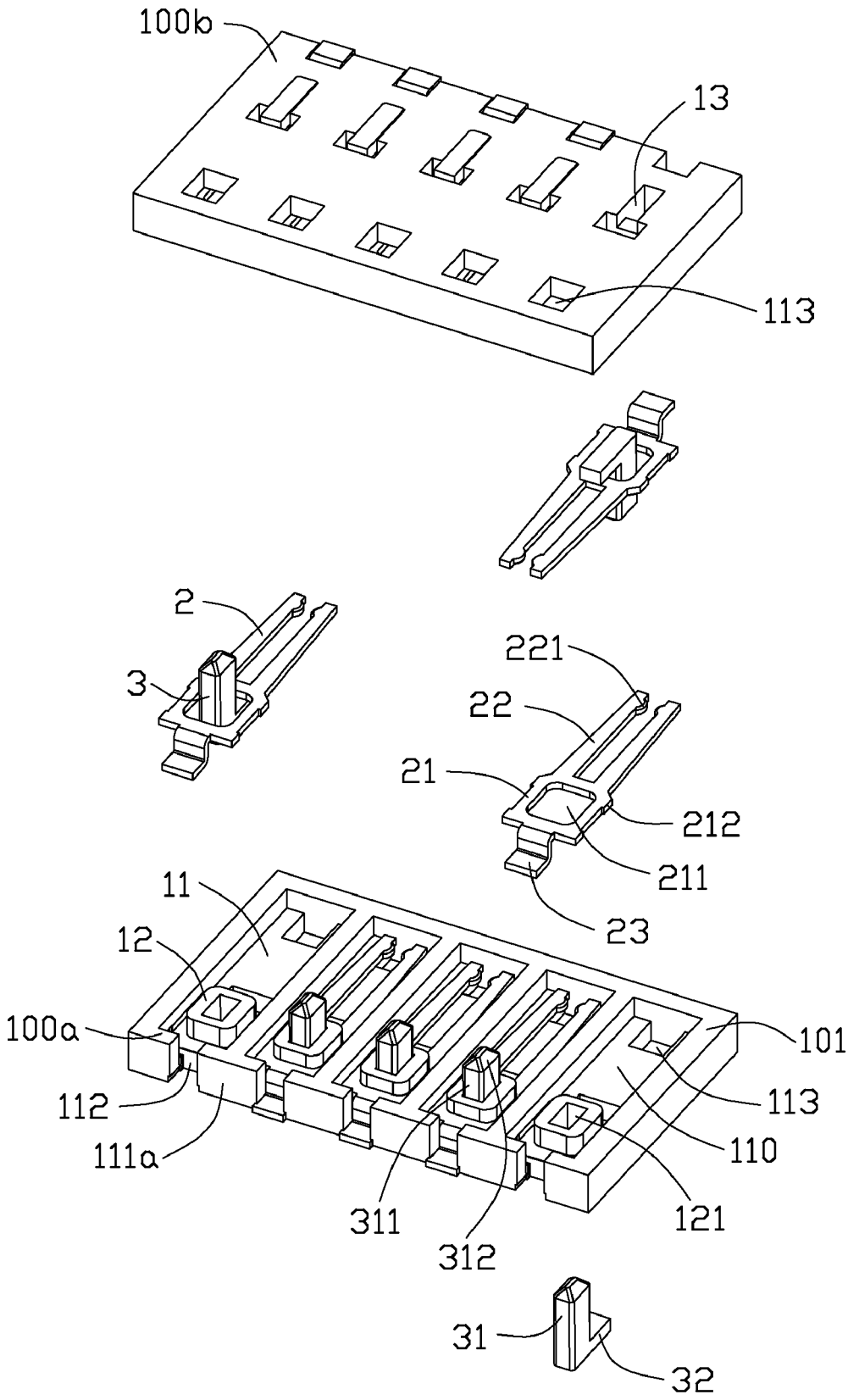
FIG. 3 is an exploded, perspective view of FIG. 1.
Figure 4:
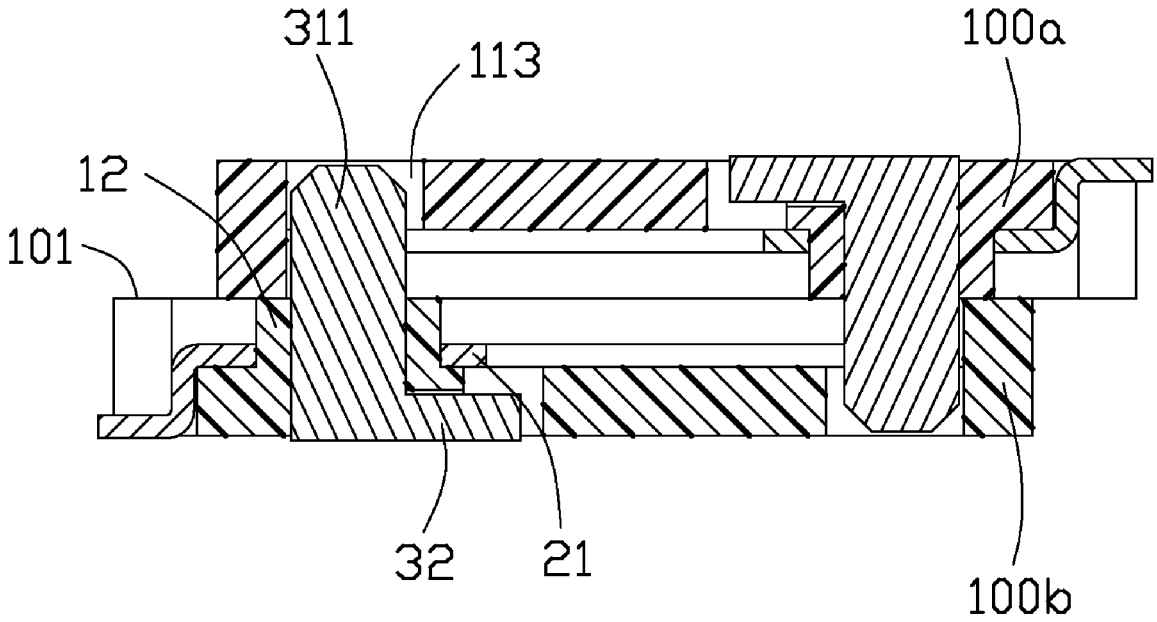
FIG. 4 is a cross-sectional view of the connector assembly as shown in FIG. 1, taken along line 4-4.

Referring to FIGS. 2 and 3, the rectangular insulating housing 1 defines a mating surface 101 and a mounting surface 102 opposite to the mating surface 101. A plurality of rectangular receiving grooves 11 are recessed in the mating surface 101 and arranged along a longitudinal direction of the housing 1. Each longitudinal receiving groove 11 extends along a second direction perpendicular to the longitudinal direction and is enclosed by four sidewalls. A plurality of rectangular positioning posts or sleeves 12 are located adjacent to a sidewall 111*a* along the second direction and extend upwardly from bottom faces 110 of the corresponding receiving grooves 11. The positioning posts 12 don't extend beyond the mating surface 101. In this embodiment, the positioning posts 12 define a top surface coplanar to the mating surface 101. Each positioning post 12 has a smaller dimension than the receiving groove 11 and are spaced at a distance from the four sidewalls of the groove 11. A plurality of positioning holes 121 penetrate through the top surface of the positioning post 12 and the mounting surface 102. A plurality of recesses 112 are formed in the sidewall 111 and run through the mating surface 101 and the mounting surface 102 of the housing 1. The recesses 112 communicate with the corresponding receiving grooves 11. A plurality of cavities 113 are formed in the bottom faces 110 and located adjacent to another sidewall opposite to the sidewall 111.

Each first terminal 2 is made from a metal sheet and comprises a retention portion 21 with a through hole 211 formed therein. At least one pair of barbs extends outwardly from opposite sides of the retention portion 21. A pair of spring arms 22 extends forwardly from one end of the retention portion 21. Two curved protrusions project from tips of the spring arms 22 toward each other and form contact points 221. A solder portion 23 extends downwardly then rearward from the other end of the retention portion 21. The first terminals are assembled to the receiving grooves 11 from the mating surface 101. In the meantime, the positioning posts 12 are respectively inserted through the through holes 211 and the barbs 212 interfere with the opposite sidewalls of the receiving grooves 11. The retention portions 21 and spring arms 22 abut against the bottom face 110 of the grooves 11. The two contact points 221 are located above the corresponding cavity 113. The solder portions 23 located on the mounting surface 102 run through the respective recesses 112 and extend beyond the sidewall. The two contact points 221 define a mating direction perpendicular to the mating surface 101.

Each second terminal 3 is made from a metal post and includes a horizontal solder portion 32 and a vertical portion 31 extending upwardly from the solder portion 32. The second terminals 3 are respectively assembled to the insulative housing 1 from the mounting surface 102. The solder portions 32 are received in respective grooves 13 which are formed in the mounting surface 102 and communicate with the corresponding positioning holes 121. The solder portions 32 project beyond the mounting surface 102 so as to be soldered to the PCB. The vertical portions 31 penetrate through the corresponding positioning holes 121 and extend beyond the top surface of the positioning posts 12. The vertical portions 31 define contacting sections 311 which are located above the top surface of the posts 12 and tapered guide sections 312 formed from tips of the contacting sections 311.

When the hermaphroditic connectors 100*a* and 100*b* mate with each other, the contacting sections 311 of the second terminals 3 are sandwiched between the corresponding spring arms 22 of the first terminals 2 so that contacting points 221 and the contacting sections 311 of the second terminals form an electrical connection. In the meantime, tip ends of the contacting sections 311 are received in the corresponding cavities 113. The arrangement of the first and second terminals benefits a lower profile of the connector and facility of engagement of the connector.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising:

an insulative housing defining a mating surface and a mounting surface opposite to the mating surface;

a plurality of first terminals retained in the insulative housing, each first terminal made from a metal sheet and comprising a retention portion and a pair of spring arms extending from the retention portion, a pair of contacting points projecting from the spring arms and defining a mating direction perpendicular to the mating surface; and a plurality of second terminals retained in the housing, each second terminal made from a metal post and comprising a contacting portion perpendicular to the mating surface;

wherein the second terminals penetrate through and are insulated from the first terminals, respectively.

2. The electrical connector as recited in claim 1, wherein the insulative housing defines a plurality of receiving grooves recessed from the mating surface, the first terminals abut against corresponding bottom faces of the receiving grooves, the second terminals penetrating through the bottom faces define contacting sections extending beyond the mating surface.

3. The electrical connector as recited in claim 2, wherein a cavity is formed in the bottom face of each receiving groove and aligns with the contacting section of the second terminal.

4. The electrical connector as recited in claim 3, wherein the retention portion of the first terminal have a through hole formed therein, a positioning post projects from the bottom face of the groove and penetrates through the through hole.

5. The electrical connector as recited in claim 4, wherein the positioning post defines a positioning hole formed therethrough so as to retain the second terminal, the contacting section of the second terminal extends beyond a top surface of the positioning post.

6. The electrical connector as recited in claim 5, wherein the positioning post does not extend beyond the mating surface.

7. The electrical connector as recited in claim 5, wherein the contacting points of the first terminal align with the corresponding cavity.

8. An electrical connector assembly comprising: first and second connectors substantially identical with each other and adapted to be face to face mated with each other in a vertical direction; each of said first and second connectors including an insulative housing with a plurality of male contacts aligned with one another in a lengthwise direction perpendicular to said vertical direction, and a plurality of female contacts aligned with one another in said lengthwise direction under condition that the male contacts of the first connector are adapted to mate with the female contacts of the second connector and the female contacts of the first connector are adapted to mate with the male contacts of the second connector; wherein in either one of said first connector and said second connector, the male contact contacts are substantially located on one side of the corresponding housing in a transverse direction perpendicular to both said vertical direction and said lengthwise direction, and the female contacts essentially extend from said side toward and terminate on the other side along said transverse direction.

9. The electrical connector assembly as claimed in claim 8, wherein tails of the male contacts horizontally extends toward said other side while terminates before reaching a centerline of the corresponding in said transverse direction.

10. The electrical connector assembly as claimed in claim 8, wherein tails of the female contacts are located on an outermost edge of said side of the housing.

11. The electrical connector assembly as claimed in claim 8, wherein a contacting section of the male contact extends in the vertical direction and terminates at a level higher than that of a contacting section of the female contact which extends in the transverse direction.

12. The electrical connector assembly as claimed in claim 8, wherein each of the female contacts is essentially in form of a lying fork while each of the male contacts is essentially in form of an upstanding post.

13. The electrical connector assembly as claimed in claim 8, wherein the housing defines a plurality of sleeves each enclosing the corresponding male contact and enclosed by the corresponding female contact.

14. The electrical connector assembly as claimed in claim 13, wherein each of said female contacts defines a retention structure around the corresponding sleeve.

15. A hermaphroditic electrical connector for coupling to another identical connector, comprising:

an insulative housing defining a lengthwise direction and a transverse direction perpendicular to each other;

a plurality of male contacts arranged with one another along the lengthwise direction and commonly located on one side of the housing in said transverse;

a plurality of female contacts arranged with one another along the lengthwise direction, each of said female contacts extends from said side of the housing toward and terminates on the other side in said transverse direction;

wherein each of the male contacts primarily extends in a vertical direction perpendicular to both said lengthwise direction and said transverse direction while each of said female contacts primarily extends in said transverse direction.

16. The hermaphroditic electrical connector as claimed in claim 15, wherein the housing defines a plurality of sleeves along the lengthwise direction, and each of said sleeves extends in a vertical direction and surrounds the corresponding male contact.

17. The hermaphroditic electrical connector as claimed in claim 16 wherein each of said sleeves further is enclosed by the corresponding female contact.

18. The hermaphroditic electrical connector as claimed in claim 15, wherein tails of the female contacts extend outwardly on an outermost edge of the housing on said side.

19. The hermaphroditic electrical connector as claimed in claim 18, tails of the male contacts extend horizontally toward the other side in said transverse direction.

20. The hermaphroditic electrical connector as claimed in claim 15, wherein the housing is configured to allow the male contacts to be only upwardly assembled thereto in the vertical direction while allow the female contacts to be only downwardly assembled thereto in the vertical direction.

* * * * *